US006682464B2

(12) United States Patent
Shifferaw

(10) Patent No.: US 6,682,464 B2
(45) Date of Patent: Jan. 27, 2004

(54) ADJUSTABLE DUMBBELL/BARBELL

(76) Inventor: Tessema Dosho Shifferaw, 3000 Giant Rd., San Pablo, CA (US) 94806

( * ) Notice: Subject to any disclaimer, the term of this patent is extended or adjusted under 35 U.S.C. 154(b) by 159 days.

(21) Appl. No.: 09/767,344

(22) Filed: Jan. 22, 2001

(65) Prior Publication Data

US 2002/0107118 A1 Aug. 8, 2002

(51) Int. Cl.[7] ..... A63B 21/072; A63B 21/075

(52) U.S. Cl. ..... 482/106; 482/104; 482/105; 482/148; 482/107; 482/108

(58) Field of Search ..... 482/104, 106–108, 482/148

(56) References Cited

U.S. PATENT DOCUMENTS 4,971,318 A * 11/1990 Tracy ..... 272/123
5,123,885 A * 6/1992 Shields ..... 482/106
5,415,607 A * 5/1995 Carpenter ..... 482/106
5,630,776 A * 5/1997 Yang ..... 482/104
5,839,997 A 11/1998 Roth et al.
6,033,350 A 3/2000 Krull
6,039,678 A * 3/2000 Dawson ..... 482/107
6,149,558 A 11/2000 Chen
6,186,928 B1 * 2/2001 Chen ..... 482/107

FOREIGN PATENT DOCUMENTS

JP 8277983 * 10/1996 ..... 285/5

* cited by examiner

*Primary Examiner*—Nicholas D. Lucchesi
*Assistant Examiner*—L Amerson
(74) *Attorney, Agent, or Firm*—Edward S. Wright

(57) ABSTRACT

Dumbbell/barbell with a bar and a plurality of weights mounted on the bar, with the bar passing through openings in the weights and each of the weights being formed in sections which are hinged together and can be separated for disengagement from the bar.

12 Claims, 3 Drawing Sheets

ADJUSTABLE DUMBBELL/BARBELL

BACKGROUND OF THE INVENTION

1. Field of Invention

This invention pertains generally to exercise and fitness equipment and, more particularly, to a an adjustable dumbbell and barbell for use in weight training.

2. Related Art

With conventional dumbbells and barbells with removable weights, it is very cumbersome to change the weight plates. It is generally necessary to removing a locking collar from each end of the bar, remove the undesired plates, add the desired ones, and put the collar back on the bar. The unused plates are often left lying around or stacked on the floor.

In recent years, there have been some attempts to provide weightlifting devices in which the weights can be changed more easily. U.S. Pat. No. 5,839,997, for example, discloses a dumbbell in which the bar is selectively engagable with different weights in a stack by rotation of the bar, and U.S. Pat. Nos. 6,033,350 and 6,149,558 show devices having axially extensible pin for engaging progressively more of the weights in a stack. Each of these devices has its own limitations and disadvantages.

OBJECTS AND SUMMARY OF THE INVENTION

It is in general an object of the invention to provide a new and improved dumbbell and barbell.

Another object of the invention is to provide a dumbbell and barbell of the above character in which the weight is readily adjusted.

Another object of the invention is to provide a dumbbell and barbell which overcome the limitations and disadvantages of the prior art.

These and other objects are achieved in accordance with the invention by providing a dumbbell/barbell with a bar and a plurality of weights mounted on the bar, with the bar passing through openings in the weights and each of the weights being formed in sections which are hinged together and can be separated for disengagement from the bar.

DETAILED DESCRIPTION

Figure 1:
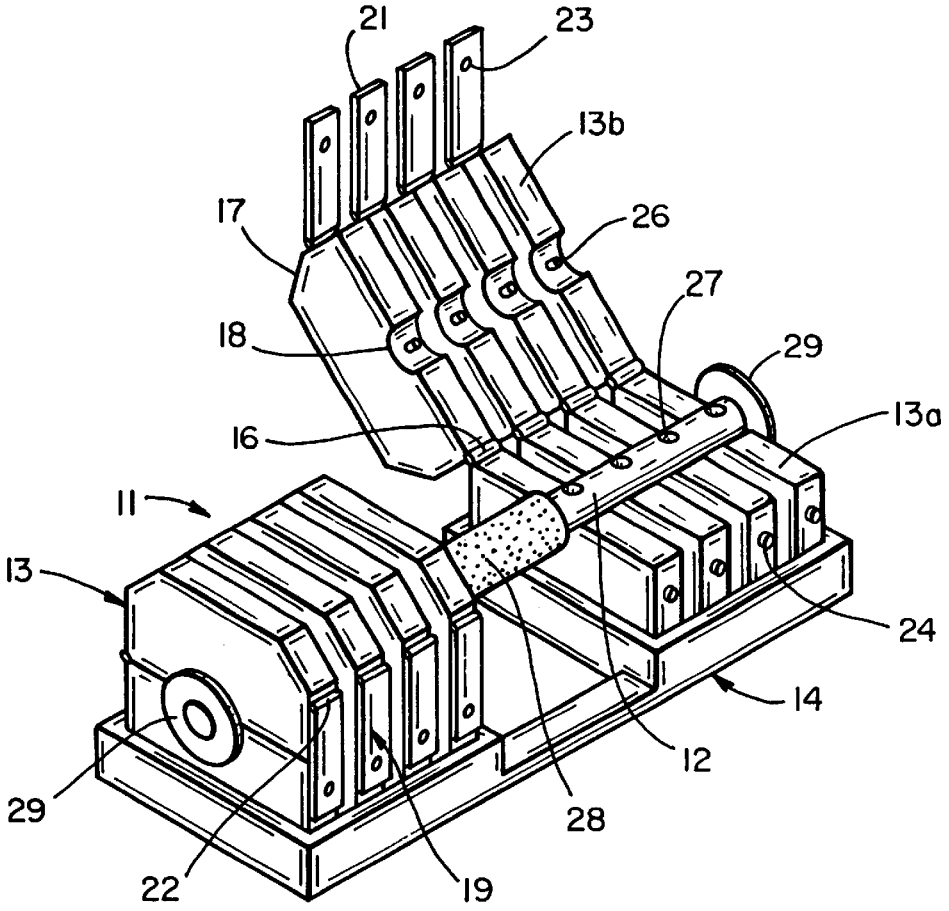
FIG. 1 is an isometric view of one embodiment of an adjustable dumbbell incorporating the invention.
Figure 2:
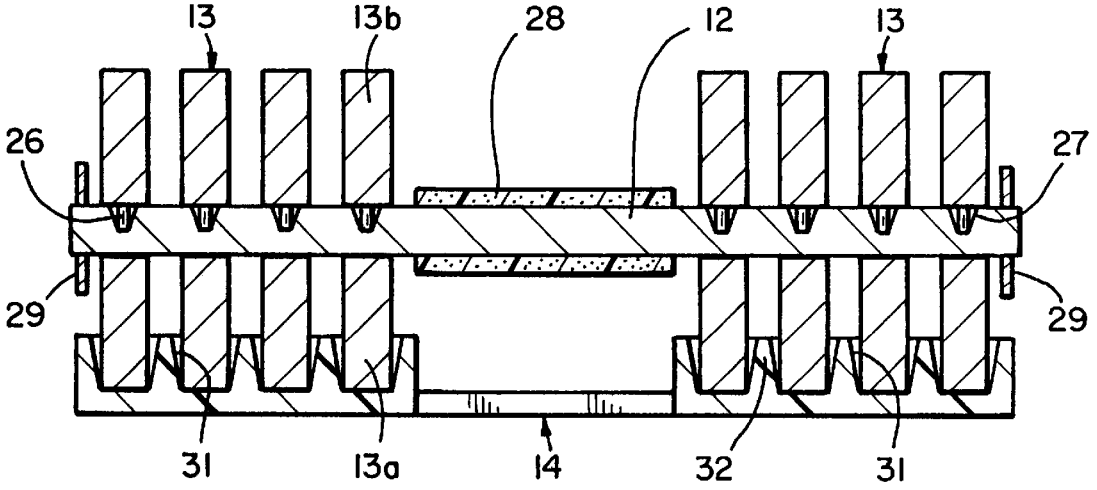
FIG. 2 is a vertical sectional view of the embodiment of FIG. 1.
Figure 3:
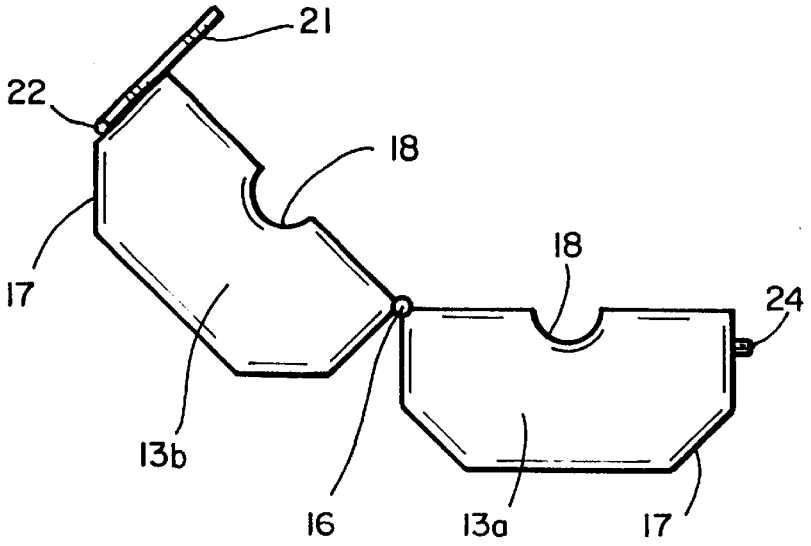
FIG. 3 is an elevational view of one of the weight plates in the embodiment in FIG. 1 in an open position and removed from the bar.
Figure 4:
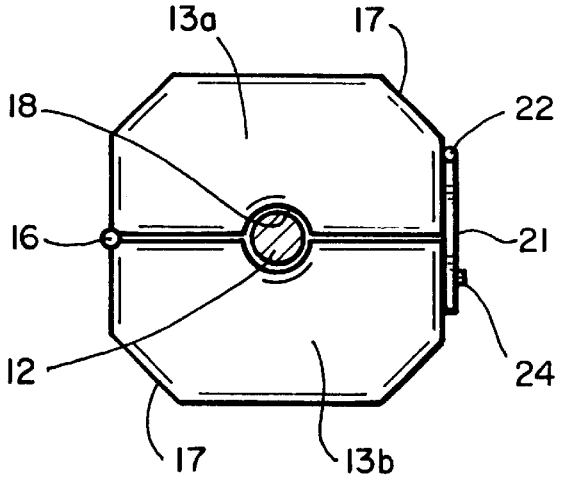
FIG. 4 is an elevational view of one of the weight plates in the embodiment in FIG. 1 in a closed position about the bar.

In FIG. 1, the invention is illustrated in the form an adjustable dumbbell 11 having a bar 12, a plurality of weight plates 13 removably mounted on the bar, and a tray 14 for holding the plates when they are not in use.

Each of the plates is formed in two sections 13*a*, 13*b* which are connected together by a hinge 16 for movement between open and closed positions.

In this particular embodiment, the plates are illustrated as being generally square, with mitered corners 17. Each plate has a central opening 18 in which the bar is received. The opening is formed partly in each of the two sections 13*a*, 13*b*, and when the plate is in its closed position, the walls of the opening encircle the bar. In the open position, the bar can be lifted into and out of the opening.

Each plate also has a latch 19 for holding the plate in its closed position. As illustrated, the latch includes a latch plate 21 which is attached to one of the plate sections by a hinge 22 and has an opening 23 for receiving a pin 24 affixed to the other section of the plate. If desired, other types of latches or fasteners can be used, including Velcro fasteners.

Each of the plates also has a locating pin 26 for retaining the plate in a predetermined position on the bar. These pins extend radially from the walls of the openings 18 in the upper sections of the plates and are received in sockets 27 in the bar.

A rubber hand grip 28 is mounted on the central portion of the bar, and end plates 29 are affixed to the two ends of the bar.

Tray 14 is divided into pockets 31 in which the individual weight plates are received. The pockets are separated by dividers 32, and the spacing between them corresponds to the spacing of the weight plates on the bar. The tray serves as a holder for the entire dumbbell when it is not in use, and for any of the weight plates which have been disengaged from the bar.

In use, the dumbbell is placed in the tray, and the exerciser closes and latches any of the plates he wants to use and opens the others. Thereafter, when he lifts the bar, the closed ones will go with it, and the open ones will remain behind in the tray.

When the exercise is finished, the dumbbell is returned to the tray, with the open plates still being in the proper position to receive the bar.

Figure 5:
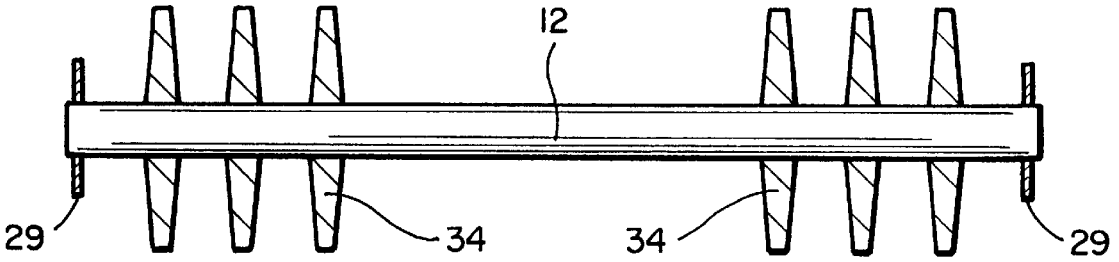
FIG. 5 is a side elevational view of an alternate bar for use in the dumbbell of the invention.

The bar illustrated in FIG. 5 has axially spaced radial flanges 34 for holding the weight plates in position. The flanges can be affixed to the bar by any suitable means such as welding, set screws, and the like, and the weight plates go on the bar between the flanges.

Figure 6:
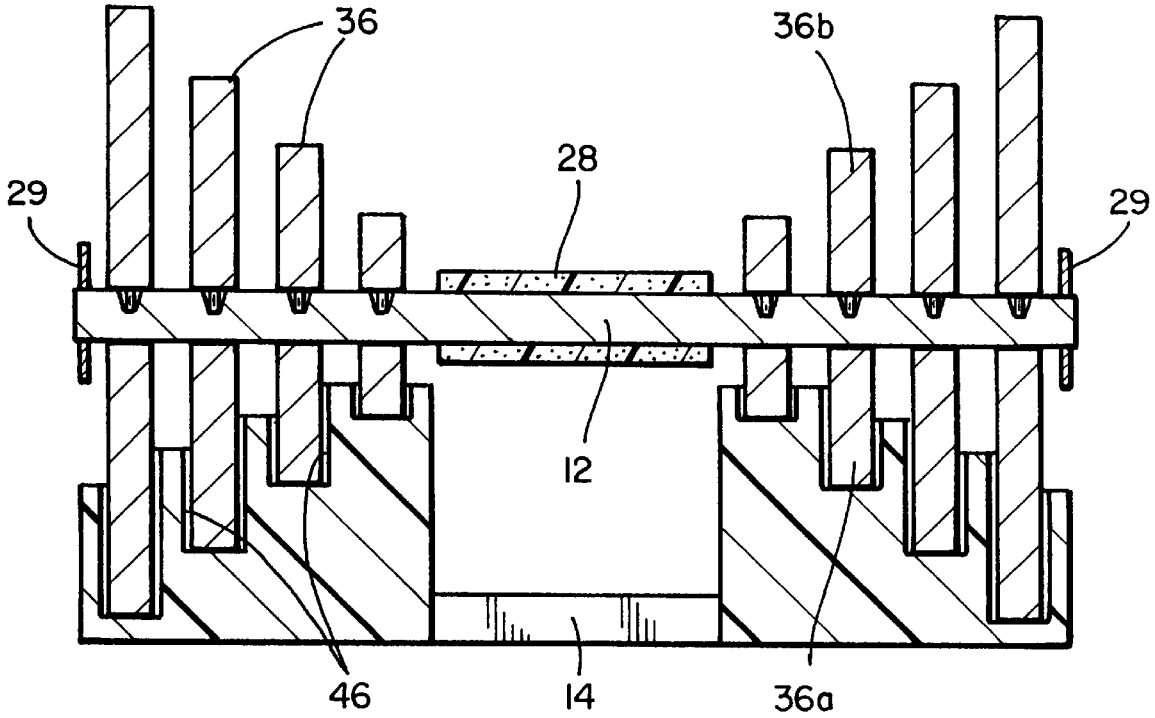
FIG. 6 is a vertical sectional view of another embodiment of an adjustable dumbbell incorporating the invention.
Figure 7:
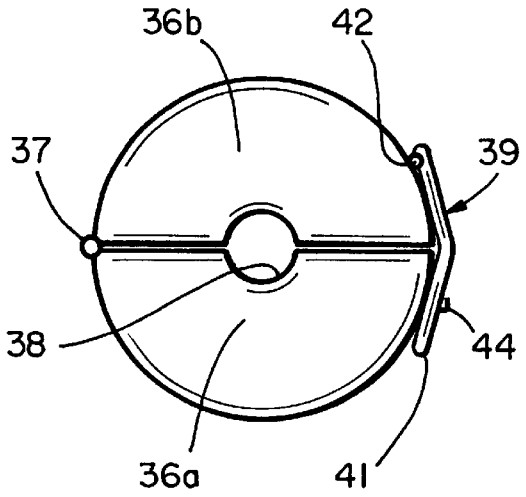
FIG. 7 is an elevational view of one of the weight plates in the embodiment in FIG. 6.

The embodiment of FIG. 6 is similar to the embodiment of FIG. 1 except that it has circular weight plates 36 of differing diameters and weights. Each of these plates has two semicircular sections 36*a*, 36*b*, with a hinge 37 connecting them together, a central opening 38, and a latch 39 for locking the two sections together in a closed position. This latch is similar to the latch in the embodiment of FIG. 1 and includes a latch plate 41 which is attached to plate section 36*b* by a hinge 42 and engagable with a latch pin 44 affixed to plate section 36*a*.

In this embodiment, depth of the pockets 46 in the tray which holds the weight plates have a depth corresponding to the lateral dimension or diameter of the plates.

The invention has a number of important features and advantages. It provides an adjustable dumbbell/barbell the weight of which is easily and safely adjusted. The weights can be engaged with and disengaged from the bar with a single hand, and they are securely attached to the bar when engaged with it. The tray holds the weights in the proper position for reattachment to the bar when they are disengaged from it.

It is apparent from the foregoing that a new and improved dumbbell and barbell have been provided. While only certain presently preferred embodiments have been described in detail, as will be apparent to those familiar with the art, certain changes and modifications can be made without departing from the scope of the invention as defined by the following claims.

What is claimed is:

1. An adjustable dumbbell/barbell, comprising: a bar, a plurality of weights formed in sections which are hinged together for movement between closed and open positions for engagement with and disengagement from the bar, and pins engagable between the weights and the bar for holding the weights in position on the bar.

2. An adjustable dumbbell/barbell, comprising: a bar, a plurality of weights formed in sections which are hinged together for movement between closed and open positions for engagement with and disengagement from the bar, and axially spaced radial flanges interposed between adjacent ones of the weights for holding the weights in predetermined positions on the bar.

3. An adjustable dumbbell/barbell, comprising: a bar, a plurality of weights formed in sections which are hinged together for movement between closed and open positions for engagement with and disengagement from the bar, and a tray having individual pockets for receiving respective ones of the weights and holding the weights in predetermined positions both when the weights are mounted on the bar and when they are disengaged from the bar.

4. The dumbbell/barbell of claim 3 wherein the weights are generally square plates formed in two sections connected together on one side by a hinge, with a releasable latch on the opposite side holding the two sections together.

5. The dumbbell/barbell of claim 3 wherein the weights are circular plates formed in semicircular sections connected together by a hinge, with a releasable latch holding the two sections together.

6. The dumbbell/barbell of claim 3 wherein the weights are plates of differing lateral dimension, and the pockets in the tray have depths corresponding to the lateral dimensions of respective ones of the plates.

7. An adjustable dumbbell/barbell, comprising: a bar, a plurality of weight plates formed in sections which are hinged together for movement between closed and open positions for engagement with and disengagement from the bar, means for holding the plates in the closed position, and a tray having individual pockets for receiving respective ones of the weight plates and holding the plates in predetermined positions both when the plates are in the closed position and engaged with the bar and when they are in the open position and disengaged from the bar.

8. An adjustable dumbbell/barbell, comprising: a bar, a plurality of weight plates formed in sections which are hinged together for movement between closed and open positions for engagement with and disengagement from the bar, the weight plates having openings in which the bar is received, means for holding the plates in the closed position, and pins extending from the walls of the openings into sockets in the bar for holding the plates in position on the bar.

9. An adjustable dumbbell/barbell, comprising a bar, a plurality of weight plates formed in sections which are hinged together for movement between closed and open positions for engagement with and disengagement from the bar, means for holding the plates in the closed position, and axially spaced radial flanges interposed between adjacent ones of the weight plates for holding the weights in predetermined positions on the bar.

10. An adjustable dumbbell/barbell having a bar and a plurality of weight plates mounted on the bar, wherein each of the plates is formed in two sections and has a central opening formed partially in each of the two sections, a hinge connecting the sections together for movement between a closed position in which the walls of the opening encircle the bar and an open position in which the bar can be removed from the opening, a latch for holding the two sections of the plate in the closed position, and pins extending from the walls of the openings into sockets in the bar for holding the plates in position on the bar.

11. An adjustable dumbbell/barbell having a bar and a plurality of weight plates mounted on the bar, wherein each of the plates is formed in two sections and has a central opening formed partially in each of the two sections, a hinge connecting the sections together for movement between a closed position in which the walls of the opening encircle the bar and an open position in which the bar can be removed from the opening, a latch for holding the two sections of the plate in the closed position, and axially spaced radial flanges interposed between adjacent ones of the weight plates for holding the plates in predetermined positions on the bar.

12. An adjustable dumbbell/barbell having a bar and a plurality of weight plates mounted on the bar, wherein each of the plates is formed in two sections and has a central opening formed partially in each of the two sections, a hinge connecting the sections together for movement between a closed position in which the walls of the opening encircle the bar and an open position in which the bar can be removed from the opening, a latch for holding the two sections of the plate in the closed position, and a tray having individual pockets for receiving respective ones of the weight plates and holding the plates in predetermined positions both when the plates are in the closed position and engaged with the bar and when they are in the open position and disengaged from the bar.

* * * * *